United States Patent [19]

Peterson

[11] 3,995,405

[45] Dec. 7, 1976

[54] PANEL MOLDING

[75] Inventor: Thomas R. Peterson, Spring Lake, Mich.

[73] Assignee: Structural Concepts Corporation, Spring Lake, Mich.

[22] Filed: June 25, 1975

[21] Appl. No.: 590,390

[52] U.S. Cl. ..... 52/627; 52/476

[51] Int. Cl.[2] ..... E04C 2/00

[58] Field of Search ..... 52/627, 628, 476, 213, 52/217, 586; 49/DIG. 1, 485, 489

[56] References Cited

UNITED STATES PATENTS

| | | | |
|---|---|---|---|
| 2,167,772 | 8/1939 | Owen | 52/476 X |
| 3,303,626 | 2/1967 | Brigham | 52/627 X |
| 3,363,385 | 1/1968 | Evans et al. | 52/476 X |
| 3,455,080 | 7/1969 | Meadows | 52/628 X |

FOREIGN PATENTS OR APPLICATIONS

| | | | |
|---|---|---|---|
| 277,944 | 11/1964 | Netherlands | 52/476 |

*Primary Examiner*—J. Karl Bell
*Attorney, Agent, or Firm*—McGarry & Waters

[57] ABSTRACT

A two-piece panel molding having an L-shaped base which is attached to a support through a foamed adhesive tape. The base has an upright retaining flange at one side to abut a marginal facing edge on a panel and a slot at an opposite side. The thickness of the base is substantial to comfortably accommodate the slot and to provide rigid support therefor. A plurality of upwardly opening channels are formed in the base. A retainer has a panel retaining means to abut an opposite facing edge of the panel and has a locking flange which fits within the slot of the base. Means, for example, complementary serrated edges in the locking flange and the slot, retain the locking flange adjustably within the slot. The panel engaging retaining means can comprise a single flange to retain a thick panel or a lateral web with one or more depending flanges to retain thinner panels.

11 Claims, 3 Drawing Figures

PANEL MOLDING

BACKGROUND OF THE INVENTION

1. Field of the Invention

This invention relates to panel molding of the type wherein a retainer is snapped into a base to hold the panel fixed within a support.

2. State of the Prior Art

In office partition systems, it is common to provide a plurality of support posts interconnected by rigid wall panels. The wall panels can be glass, in whole or in part, plywood, or plastic or combinations thereof. The panels can vary in thickness from one-quarter to three-quarters of an inch. Typically, such panels are supported by removable braces between top and bottom marginal edges and are connected to the vertical support posts at the sides.

In one system, modular panel units are constructed in one piece and joined to other such modular units at the support posts. Such units are bulky, heavy and thus difficult to handle. Further, the heaviness of the panels causes excessive stress at the joints of those panels which are only supported at one edge during the assembly process. Such stress may require additional labor to hold the panel until it is fully supported at both sides thereof. Once the system is constructed, it is difficult to change and modify the panels without substantial efforts.

In order to overcome the problems inherent in the prefabricated panel system, it has been proposed to assemble the framework for the panels first and to thereafter assemble the panels to the framework. Assembly of the panels is much easier and substitution of panels is greatly facilitated by this system. However, suitable molding which is easy to assemble, yet which holds the panel securely to the framework, must be provided. Further, the moldings must be easily removed so that the panels can be replaced or disassembled.

One prior molding system includes an L-shaped base which is secured to a frame post through a suitable adhesive and a retainer which is snap-fit into the base. An upstanding flange on the base abuts one marginal facing edge of the panel and a flange on the retainer abuts the other marginal facing edge of the panel. The base has a series of longitudinal grooves in its top surface to receive a retainer projection through which the retainer is held on the base.

Unfortunately, variations in size and shapes of the panel can cause difficulties in the assembly and maintenance of this molding system. The variation in the thickness and shape results in an outward force on partitions of the retainer flange which, through a bending moment, tends to pull the projection out of the base groove. Further, once seated, the retainer is difficult to dislodge from the base.

SUMMARY OF THE INVENTION

According to the invention, the base of a two-panel molding system is characterized by a cross-section with an upright retaining flange extending from one side of the base to abut a first marginal edge of a panel. A lateral slot opens from an opposite side of the base and extends in a direction generally parallel to the top and bottom of the base. The slot is spaced between the top and bottom sides of the base and the base is sufficiently thick to provide a relatively rigid flange between the slot and the top and bottom sides of the base. Means on the top side of the base form a seating surface for the marginal end of the panel. Means are provided at the bottom edge of the base to secure the base to a support structure.

A one-piece extruded retainer of indefinite length and formed of a plastic or aluminum material is characterized by a cross-sectional configuration having an upright retaining means adapted to abut a second marginal facing edge of the panel and a laterally extending locking flange sized to fit within the base lateral slot. Means are provided for retaining the locking flange within the slot.

A laterally extending support means is formed beneath the slot on the base. The retainer has a thickened bottom edge commencing at the locking flange and abutting the base support means. The thickened portion of the retainer forms a solid reinforcement of the retainer at and beneath the locking flange to resist any bending moments which may tend to pull the locking flange from the slot. As a result of this thickened portion, the forces against the retaining means by the panel will cause a slight resilient bending of the retainer above the locking flange so that the locking flange is securely retained within the slot regardless of the variations in thickness or shape of the panels.

Desirably, the locking flange and the slot have serrated surfaces which form the retaining means therebetween. The serrated surfaces thus permit positioning of the locking flange in various adjusted positions within the slot.

The panel-retaining means on the retainer can comprise a single upright flange adjacent to the side edge of the panel for abutting a relatively thick panel or can comprise a lateral web which extends over the top side of the base and at least one downwardly extending channelforming flange.

The base preferably has a plurality of hollow channels opening at the top side thereof and adjacent to the slot. Further, the base desirably contains a recessed channel on the bottom portion thereof in which channel is positioned an adhesive strip having a soft resilient foam substrate. The adhesive strip has adhesive on both sides so that the strip is secured at one side to the base and can be secured at the other side to a supporting frame member.

BRIEF DESCRIPTION OF THE DRAWINGS

The invention will now be described with reference to the accompanying drawings in which.

DESCRIPTION OF THE PREFERRED EMBODIMENTS

Figure 1:
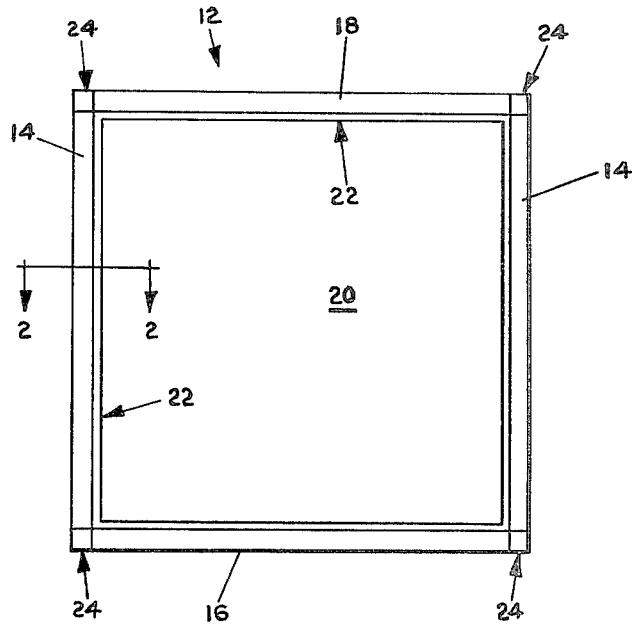
FIG. 1 is a plan view of a panel section incorporating the molding structure according to the invention.
Figure 2:
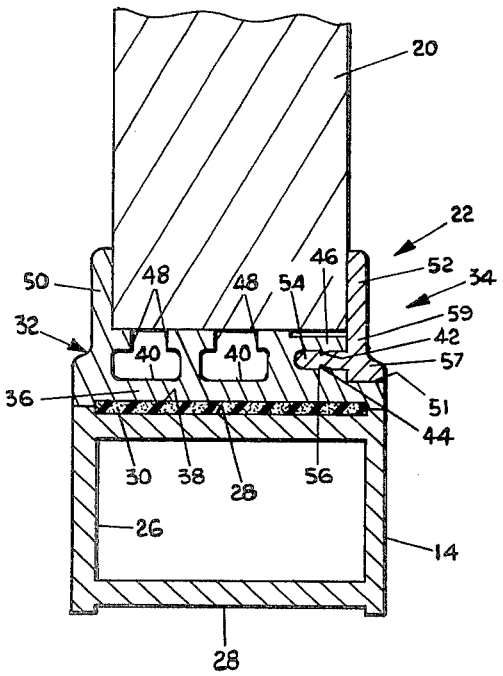
FIG. 2 is a partial sectional view seen along lines 2—2 of FIG. 1.

Referring now to the drawings, and to FIG. 1 and 2 in particular, there is shown a panel construction 12 formed from a pair of side posts 14 connected at the bottom to a bottom rail 16 and at the top to a top rail 18. Fasteners 24 of the type disclosed and claimed in U.S. Pat. No. 3,532,369 can be used to secure the side post 14, the bottom rail 16 and the top rail 18 together. A panel 20 is retained between the posts 14, the bottom and top rails 16 and 18 by molding 22.

As seen in FIG. 2, the side post 14 is of conventional construction having a hollow interior 26 and recessed channels 28 at opposite sides thereof. Foam addhesive tape 30 formed of a strip of resilient foam sandwiched between two adhesive layers is positioned within a hollow channel 28 and adhesively secured thereto. compressability tolerances The molding 22 is formed from a base 32 and a retainer 34. The base 32 has a bottom portion 36 with a recess 38 in which is positioned to foam adhesive tape 30. The tape 30 is adhesively secured to the base 32 at the recess 38 to adhesively secure the base 32 to the side post 14. The foam tape 30 is important to secure the base 32 continuously throughout its length to the post 14. The compressability of the tape permits some variation in tolerances between the base 32 and the post 14.

The base 32 has a plurality of channels 40 with inwardly directed lips 48 at the top portions thereof forming a seating edge for the panel 20. A laterally extending slot 42 is formed along one edge of the base bottom portion 36 leaving a rigid flange 46. Inward retaining serrations 44 are provided in the interior of the slot 42. A retaining flange 50 extends upwardly along one side of the base bottom portion 36 in retaining engagement with the side edge of the panel 20. A lateral support ledge 51 extends outwardly beneath the slot 42.

The retainer 34 has an upstanding retaining flange 52 in retaining engagement with an opposite edge of the panel 20 and has a laterally extending locking flange 54 with retaining serrations 56. The locking flange 54 snaps into the slot 42 to firmly secure the retainer 34 to the base 32. The serrations 56 mate and are complementary to the serrations 44 to securely hold the flange 54 in various adjusted positions in slot 42.

A thickened portion 57 extends from a point opposite the locking flange 54 and extends therebeneath to abut the lateral support ledge 51 of the base. This thickened portion 57 is of significant importance in preventing undesirable dislodgong of the locking flange from the slot 42. This thickened portion solidily reinforces the retainer beneath and at the locking flange to provide a firm reaction to any bending moment caused by panel pressure against the flange 52. Such panel pressure will result in bending of the flange 52, generally at or above point 59. On the other hand, if the retainer is to be removed, a slight pulling force on the retainer at or beneath the locking flange 54 will result in easy removal of the retainer from the base.

The laterally disposed slot 42 and locking flange 54 provide a means whereby the retainer can be conveniently and securely snapped to the base regardless of variations of thickness of the panel. If the panel is slightly thicker or thinner in parts, the laterally extending slot and locking flange arrangement will automatically compensate. Further the flexible nature of the retainer 34 and the laterally extending locking flange 54 provide a system which resists dislodging, even when pressure is applied from the panel 20. Yet pulling of the retainer 34 laterally from the bottom edge will dislodge the same as desired to replace or otherwse remove the panel 20.

Figure 3:
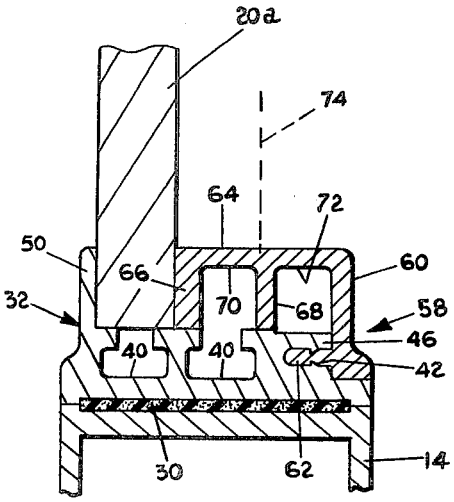
FIG. 3 is a sectional view similar to FIG. 2 of a modified form of the invention.

Reference is now made to FIG. 3 for a description of a modified form of the invention. In FIG. 3, like numerals have been used to designate like parts. In the molding illustrated in FIG. 3, the bae 32 is identical with that embodiment illustrated in FIG. 2. However, the retainer is modified to fit a thinner panel 20a. The retainer 58 has an upright flange 60 and a laterally extending locking flange 62 which fits in the laterally extending slot 42 in a manner identical with the locking flange 54 illustrated in FIG. 2. A side flange 64 extends laterally from the top portion of the upright flange 60 and contains a pair of downwardly extending legs 66 and 68 forming channels 70 and 72 respectively. As illustrated in FIG. 3, the leg 66 abuts the edge of panel 20a and retains the panel in snug engagement with the retaining flange 50 of the base 32.

If desirable, the retainer 58 can be cut or formed along dotted lines 74 so that the retainer will fit a panel of approximately twice the size of panel 20a.

Thus, with the retainer according to the invention, a standard base can be employed and separate retainers are provided for different size panels. The panels are snugly and securely retained but the retainers are adjustably secured to the bases so that compensation is made for variations of thickness and in warpage of the panel.

The base and retainers are formed as a plastic material such as polyvinyl chloride or aluminum material and can be extruded in various lengths. The extruded parts can be cut to size on the job or precut and mitered to form finished corners.

Reasonable variation and modification are possible within the scope of the foregoing disclosure and drawings without departing from the spirit of the invention which is defined by the appended claims.

The embodiments of the invention in which an exclusive property or privilege is claimed are defined as follows:

1. Panel molding for wall panels and the like comprising:

a base member of indeterminate length formed of an extruded plastic material and having a cross-sectional configuration characterized by a top, bottom and opposite sides, an upright retaining flange extending from one side of said base generally at right angles to the top side of the base and adapted to abut a first marginal edge of a panel, a lateral slot opening from an opposite side of the base and extending in a direction generally parallel to the top and bottom sides thereof, said slot being spaced sufficiently between the top and bottom sides to provide a relatively rigid flange between the slot and the top and bottom sides of the base, means on the top side of the base forming a seating surface for the panel;

means at a bottom side of the base for securing the base to a support structure;

a one-piece extruded retainer of indefinite length formed of a flexible material, said retainer having a crosssection configuration characterized by an upright panelretaining means having a flange positioned to abut a second marginal facing edge of a panel, and a laterally extending locking flange sized to fit within the base lateral slot;

means for retaining the locking flange within the slot; and a plurality of hollow channels opening at the top side of the base.

2. A panel molding according to claim 1 wherein said retaining means comprise complementary serrated surfaces in said slot and on said locking flange.

3. A panel molding according to claim 1 wherein said base has a laterally extending support means beneath said slot and said retainer has a thickened bottom edge commencing at said locking flange, said thickened bottom edge abutting said base support means to firmly resist forces which tend to pull the locking flange outwardly as the result of outward forces on the retainer upright retaining means, said thickned bottom edge resulting in a bending of the retainer means as a result of said outward forces applied above the locking flange.

4. Panel molding according to claim 3 wherein said retaining means panel abutting flange extends upwardly at the opposite side of said base.

5. Panel molding according to claim 3 wherein said retaining means extends over said top side of said base and said panel abutting flange of said retainer extends downwardly to meet the top side of said base.

6. Panel molding according to claim 5 and further comprising at least one downwardly opening channel formed in said retainer.

7. Panel molding according to claim 3 wherein said base securing means comprises an adhesive strip of indeterminate length secured to said bottom side of said base, said adhesive strip further having a soft resilient foam substrate and an adhesive layer on the obverse side of the substrate to secure said base to a support structure, whereby said base can be adhesively secured to a support structure regardless of slight variations in the base and/or support structure.

8. Panel molding according to claim 7 wherein said base further comprises a recessed channel on the bottom side thereof and said adhesive strip is positioned within said recessed channel.

9. Panel molding according to claim 1 wherein the base is further characterized by a panel support means on said top side extending inwardly over said channels to provide a supporting surface for the marginal edge of a panel.

10. Panel molding for wall panels and the like comprising:

base member of indeterminate length formed of an extruded plastic material and having a cross-sectional configuration characterized by a top, bottom and opposite sides, an upright retaining flange extending from one side of said base generally at right angles to the top side of the base and adapted to abut a first marginal edge of a panel, a lateral slot opening from an opposite side of the base and extending in a direction generally parallel to the top and bottom sides thereof, said slot being spaced sufficiently between the top and bottom sides to provide a relatively rigid flange between the slot and top and bottom sides of the base, means on the top side of the base forming a seating surface for the panel;

an adhesive strip of indeterminate length secured to said bottom side of said base, said adhesive strip further having a soft, resilient foam substrate and an adhesive layer on the obverse side thereof to secure said base to a support structure, whereby said base can be adhesively secured to a support structure regardless of slight variations in the base and/or support structure;

a one-piece extruded retainer of indefinite length formed of a flexible material, said retainer having a cross-section configuration characterized by an upright panel-retaining means having a flange positioned to abut a second marginal facing edge of a panel, and the laterally extending locking flange sized to fit within the base lateral slot; and means for retaining the locking flange within the slot.

11. Panel molding for wall panels and the like comprising:

a base member of indeterminate length formed of an extruded plastic material and having a cross-sectional configuration characterized by a top, bottom and opposite sides, an upright retaining flange extending from one side of said base generally at right angles to the top side of the base and adapted to abut a first marginal edge of a panel, a lateral slot opening from an opposite side of the base and extending in a direction generally parallel to the top and bottom sides thereof, said slot being spaced sufficiently between the top and bottom sides to provide a relatively rigid flange between the slot and the top and bottom sides of the base, means on the top side of the base forming a seating surface for the panel;

means at a bottom side of the base for securing the base to a support structure;

a one-piece extruded retainer of indefinite length formed of a flexible material, said retainer having a crosssection configuration characterized by an upright panelretaining means having a flange positioned to abut a second marginal facing edge of a panel, and a laterally extending locking flange sized to fit within the base lateral slot;

means for retaining the locking flange within the slot;

a laterally extending support means beneath said slot, said retainer having a thickened bottom edge commencing at said locking flange in abutting relationship to said base support means; and said thickened bottom edge provided firm resistance to forces which tend to pull the locking flange upwardly from engagement with the slot as a result of outward forces on the retainer upright retaining means.

* * * * *